United States Patent [19]

Phillips et al.

[11] Patent Number: 4,762,318

[45] Date of Patent: Aug. 9, 1988

[54] EXERCISER

[75] Inventors: Bradford E. Phillips; Roy J. Bertacchi, both of Cincinnati, Ohio

[73] Assignee: 'totes', incorporated, Loveland, Ohio

[21] Appl. No.: 24,309

[22] Filed: Mar. 10, 1987

[51] Int. Cl.[4] ..... D63B 21/02; F16G 11/00

[52] U.S. Cl. ..... 272/137; 24/136 K; 24/115 L; 24/115 K

[58] Field of Search ..... 272/135, 136, 137, 142; 24/115 R, 115 H, 115 K, 115 L, 136 R, 136 K, 136 C, 136 A, 115 M, 194, 196; 182/231, 235

[56] References Cited

U.S. PATENT DOCUMENTS

| | | | |
|---|---|---|---|
| 2,164,995 | 7/1939 | Linman | 24/136 K |
| 2,743,497 | 5/1956 | Davis | 24/196 |
| 3,066,373 | 12/1962 | Scholl | 24/136 A |
| 3,589,721 | 6/1971 | Cronauer | 272/137 |
| 3,654,672 | 4/1972 | Bullar | 24/136 K |
| 3,957,237 | 5/1976 | Campbell | 24/115 M |
| 3,984,081 | 10/1976 | Hoganson | 24/115 L |
| 4,019,734 | 4/1977 | Lee et al. | 272/137 |
| 4,602,891 | 7/1986 | McBride | 24/136 K |

*Primary Examiner*—Richard J. Apley
*Assistant Examiner*—J. Welsh
*Attorney, Agent, or Firm*—Wood, Herron & Evans

[57] ABSTRACT

An exerciser that includes a stretchable tension member connected to an adjuster mechanism which permits the tension member's length to be varied as desired by the user. The adjuster mechanism, in preferred form, includes a housing that defines a cavity open through a port to atmosphere. A free end of the tension member is looped around a latch pin within the cavity, both ends of the loop extending through the housing's port. The latch pin, which is accessible to a user from exteriorly of the housing, is movable within the cavity away from the port when it is desired to adjust the tension member's length, and is movable within the cavity toward the port when it is desired to lock the tension member at the desired length. The cavity includes wedge shaped interior walls that flare away from the port, and that cooperate with the pin and the tension member's looped end, to establish the locking position of that looped end.

8 Claims, 1 Drawing Sheet

EXERCISER

This invention relates to exercising equipment. More particularly, this invention relates to an exerciser of the type that includes a stretchable tension member.

Exerciser equipment is very well known to the prior art. One of the basic types of exercise equipment known is that which incorporates a stretchable tension member. One common stretchable tension member type of exerciser equipment is in the form of a chest exerciser. A chest exerciser basically includes a stretchable tension member connected between two handles. The user grips one handle with one hand and the other handle with the other hand, holds the stretchable tension member up generally parallel to the floor in front of his chest, and then tries to pull the handles away from one another. The user is able to enhance his physical well being by periodically repeating the pull-release sequence of the handles over a period of time.

In the case of a chest exerciser, one of the problems is to provide a product in which the force needed to pull the handles away from one another is adjustable or variable. Quite obviously, some end users will have a physical capacity that requires a smaller force and other end users will have a physical capacity that requires a larger force. This difference in force requirements is simply because one user is physically stronger than another user. But from a practical standpoint, it is not preferred to market a series of chest exerciser products of the same basic structure which might fulfill the variable force needs of the entire range of potential retail consumers. So it is known to the art to provide a chest exerciser of the stretchable tension member type in which the length of the tension member between the handles can be varied. This variable length tension member is incorporated in the chest exerciser in order to create a variable force system for the product. In other words, and in the case of a stretchable tension member in the form of a rubber strap, for example, it is well known that it is harder to pull apart the ends of a short length of a stretchable rubber strap than it is to pull apart the opposite ends of a long length of that stretchable rubber strap. So by providing an adjustable length stretchable tension member, the prior art acknowledges and discloses that it is possible to create a twin handle chest exerciser product which provides an adjustable force system that will be useable by a wide range of end users who vary widely in their physical capacities. And in this regard, certain structural concepts relative to this prior art are illustrated in U.S. Pat. Nos. 1,638,003, 1,729,399, 1,884,392 and 3,807,730.

There is one primary problem associated with prior art stretchable tension member exercisers of the type where the stretchable tension member is adjustable in length. This primary problem, in applicants' experience, is directed to the adjustability feature of the flexible tension member's length. In other words, the prior art adjustor mechanisms known for stretchable length tension members in the exercise product area are either relatively complex from a mechanical structure standpoint which increases the product's cost, and/or are difficult to use from the user's standpoint. In other words, the prior art discloses and illustrates variable length stretchable tension members in the chest exerciser product area where the stretchable tension member's length can be adjusted by the end user. But all such adjustor mechanisms known to applicant suffer from either structural and/or end user disadvantages of one kind or another.

Accordingly, it has been the primary objection of this invention to provide a stretchable tension member type exerciser product in which the length of that stretchable tension member, and therefor, the force necessary to stretch the stretchable tension member, is variable by use of a relatively easy to operate, and a relatively easy to manufacture, adjustor mechanism. In accord with this objective, the exerciser product of this invention includes a stretchable tension member connected to an adjustor mechanism which permits the tension member's length to be varied as desired by the user. The adjustor mechanism, in preferred form, includes a housing that defines a cavity open through a port to atmosphere. A free end of the tension member is looped around a latch pin within the cavity, both ends of the loop extending through the housing's port. The latch pin, which is accessible to a user from exteriorly of the housing, is movable within the cavity away from the port when it is desired to adjust the tension member's length, and is movable within the cavity toward the port when it is desired to lock the tension member at the desired length. The cavity includes wedge shaped interior walls that flare away from the port, and that cooperate with the pin and the tension member's looped end, to establish the locking position of that looped end.

Other objectives and advantages of this invention will be more apparent from the following detailed description taken in conjunction with the drawings in which.

Figure 1:
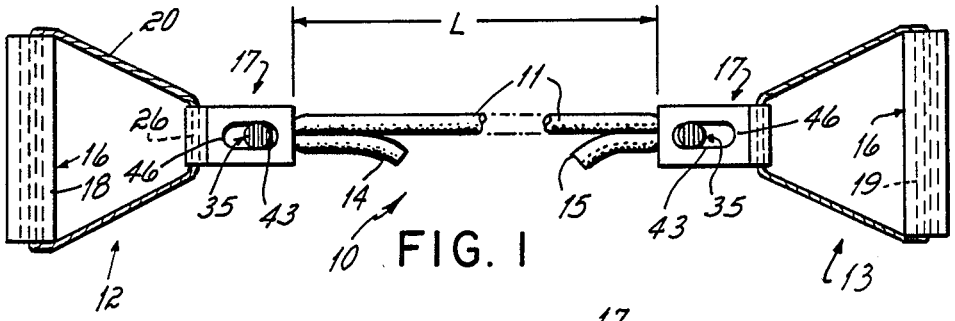
FIG. 1 illustrates a chest exerciser that incorporates a stretchable tension member length adjustor mechanism in accord with the principles of this invention.

A chest exerciser 10 in accord with the principles of this invention is illustrated in FIG. 1. The chest exerciser 10 basically includes a stretchable tension member 11 in the form of length of surgical hose that is connected between two handles 12, 13. The user grips one handle 12 with one hand and the other handle 13 with the other hand, holds the hose 11 up generally parallel to the floor in front of his chest, and then tries to pull the handles away from one another. The hose 11 length L is adjustable, i.e., the length of each of the hose's free ends 14, 15 is variable, and this permits the user to vary the force resistance of the exerciser 10.

Each handle 12, 13 includes a handle bar 16 connected to a hose length adjustor mechanism 17. The handle bar 16 is formed by a foam sleeve 18 over a rigid core 19. Each handle 12, 13 also includes a flexible closed loop 20, e.g., of heavy rope or the like, that connects the handle with the hose length adjustor mechanism 17.

Figure 2:
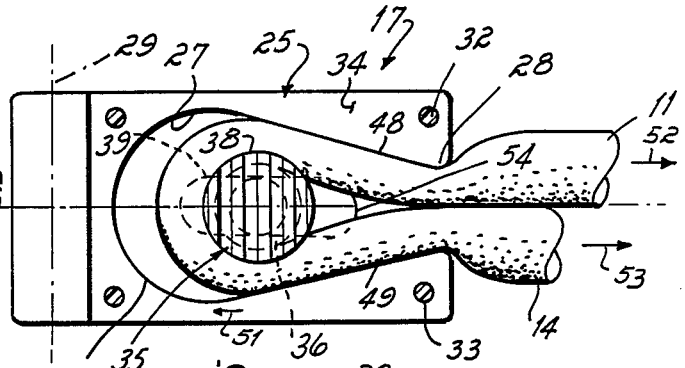
FIG. 2 is a top view of the adjustor mechanism encircled in FIG. 1.
Figure 3:
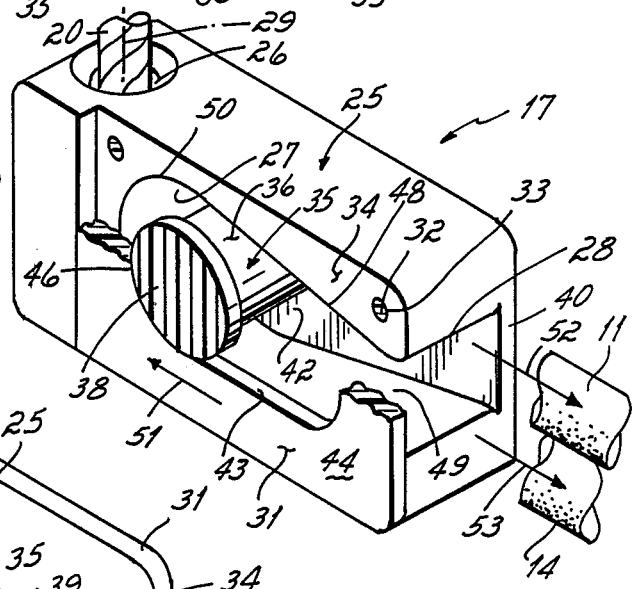
FIG. 3 is a perspective view of one side of the adjustor mechanism encircled in FIG. 1.
Figure 4:
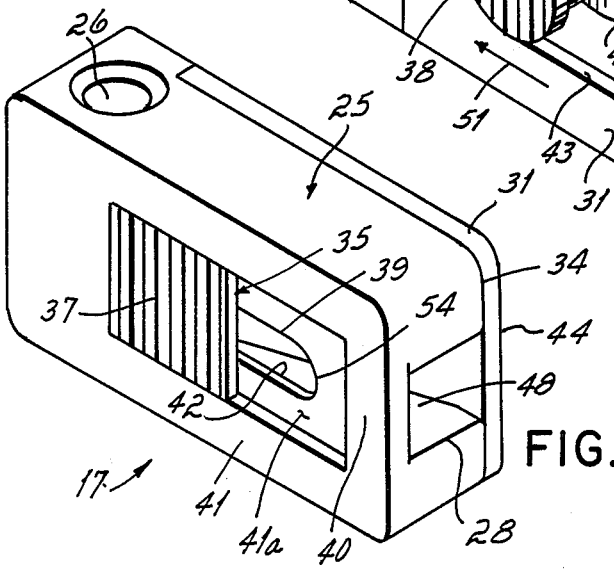
FIG. 4 is a perspective view of the other side of the adjustor mechanism encircled in FIG. 1.

It is the hose length adjustor mechanism 17 to which this invention is directed, and the structural details of that mechanism are illustrated in FIGS. 2–4. The adjustor mechanism 17 includes a housing 25, the handle loop 20 passing through bore 26 at one end of the housing, and the hose 11 being received in a horseshoe shaped cavity 27 that opens to atmosphere through port 28 at the other end of the housing. Note the axis 29 of the loop bore 26 is generally normal to the longitudinal axis 30 of the horseshoe shaped cavity 27. A removable cap 31 is fixed to the housing by friction pins 32 molded integral with the cap's underside that are received in seats 33 in the housing's cap face 34.

A latch pin 35 is carried by the housing 25, and is slideable or movable along the cavity's axis 30. The latch pin 35 axially carries a roller 36 that is freely rotatable relative thereto, the roller being held in place on the pin by square thumb plate 37 fixed to one of the pin's ends and round thumb plate 38 fixed to the other of the pin's ends. The latch pin 35 extends through slot 39 in the housing's side wall 40, and is held in assembly with the housing 25 by virtue of square thumbplate 37 overlying the outside surface 41 of the housing's side wall 40, and the roller 36 overlying the inside surface 42 of the housing's side wall 40, both components 36, 37 being of a larger dimension than slot 39 in that side wall 40. Note the longitudinal slot 39 formed in side wall 40 of the housing 25 is oriented parallel to the horseshoe cavity's longitudinal axis 30, and the square thumbplate 37 is slideable in seat 41*a* formed on the exterior face of the housing's side wall 40. So the serrated exterior face of the thumbplate 37 is generally flush with the exterior face 40 of the housing 25. The other end of the latch pin 35 includes round thumbplate 38 which, when the housing cap 31 is fixed in position, is slideable in slot 43 of that housing cap. The cap's slot 43 also is oriented parallel to the horseshoe cavity's longitudinal axis 30. Note here that the round thumbplate 37 is also serrated, and is generally flush with the housing cap's exterior surface 44 when assembled as shown in FIG. 3. But note that the housing cap's slot 43 is sized so that the associated thumbplate 38 can fit therethrough to permit removal of the cap 31, thereby exposing the housing's horseshoe shaped cavity 27 to atmosphere. The opposed slots 43, 39 in the housing's removable cap 31 and fixed side wall 40, respectively, permit the latch pin 35 of roller 36 to be slideable along the cavity's longitudinal axis 30 between a hose length adjusting position (see FIG. 3) generally adjacent ends 46 of the slots where the hose 11 can easily slide or move around the pin 35 within the cavity 27 due to roller 36 on the pin, and a hose holding or latching position adjacent the cavity's V-shaped throat (defined by the cavity's interior side walls 48, 49 which flare away from the cavity's port 28, as shown in FIG. 2) where the hose is pinched severely between the pin 35/roller 36 the side walls 48, 49 of the cavity so it cannot be pulled out of the cavity. And as previously noted, both ends of the latch pin 35 are provided with thumbplates 37, 38 so that the user can move, and thereafter hold, the latch pin at the wide end 50 of the horseshoe shaped cavity 27 while adjusting the length L of the hose 11 by pulling on the shorter long end 14, 15 of the hose or the middle segment (as desired by the user) relative to the housing.

In use, and if the stretchable length L of the flexible tension member 11 is not as desired by the chest exerciser's user, either one or both ends 14, 15 of the hose may have their free lengths adjusted relative to the stretchable length of the hose. In this regard, and if only free end 14 of the hose length needs adjustment, then the user simply retracts slideable pin 35/roller 36 through use of thumbplates 37, 38 toward the cavity's wide end 50 in the direction shown by arrow 51. This positions the pin 35/roller 36 centrally within the wide area 50 of the horseshoe shaped cavity as shown in FIG. 3, and with the user's one hand holding the pin toward that end of the slot the hose 11 is pulled in either a direction shown by arrow 52, or a direction shown by arrow 53, in FIG. 3 until the stretchable length L of the hose is as desired by the user. This is relatively easy for the user to accomplish because roller 36 on pin 35 permits the hose to be relatively easily pulled one way 52 or the other 53 around that pin when the pin is in the wide portion 50 of the horseshoe shaped cavity 27. Thereafter, the user simply pulls on both the main section of the hose 11, as well as the free end section 14 of the hose simultaneously in the direction shown by phantom arrows 52, 53 so as to pull the pin 35/roller 36 toward the latch ends 54 of the adjustor's slots 39, 43. This, in effect, wedges the hose 11, 14 tightly within the access port 28 area. And in fact, upon use of the exerciser this wedging restraint on the hose becomes even stronger because pin 35/roller 36 is continuously drawn toward port 28 to enhance the locking function, as well as to prevent the length L from varying during use.

If, upon use of the hose adjustor mechanism 17, and in attempting to adjust the hose length L, the free end 14 of the hose 11 is inadvertently pulled out of the hose adjustor's housing 25, the structure is such that it can be easily rethreaded and replaced. In this regard, the housing's cap 31 is initially removed, which removability is featured because of the friction pins 32 and the fact that the round thumbplate 38 does not overlie the slot 43 but simply is structured to pass therethrough. With the horseshoe cavity 27 so exposed, and with the pin 35/roller 36 in the generally centrally located in the major portion 50 of that cavity, the stretchable hose 11 can simply be re-looped or replaced within that cavity in the orientation illustrated in FIG. 2. Thereafter the cap 31 is simply once again friction fit into assembly with the housing to provide the closed housing 25.

Having described in detail the preferred embodiment of my invention, what I desire to claim and protect by Letters Patent is:

1. An exerciser comprising a stretchable tension member, the length of said stretchable tension member being variable as desired in order to vary the force resistance of said exerciser, a length adjustor mechanism to which said flexible tension member is connected at one end, said length adjustor mechanism including a housing having a cavity therein, said cavity being open through an access port to atmosphere, a pin slideable along an axis between a release position and a lock position within said cavity, a loop of said stretchable tension member being received in said cavity around said pin through said access port, the length of one end of said stretchable tension member being adjustable at said release position by pulling said flexible tension member around said pin and the length of that one end of said stretchable tension member being fixed at said lock position, a roller rotatably carried on said pin, said roller being in direct contact with said stretchable tension member during use, said roller being moved between said release and lock positions simultaneous with movement of said pin between said release and lock positions, said roller rotating on said pin as said flexible tension member is pulled around same to reduce the frictional resistance of pulling said flexible tension member that would otherwise be present without said roller, and a handle connected to said length adjustor mechanism by which said stretchable tension member can be stretched as desired by a user.

2. An exerciser as set forth in claim 1, said exerciser comprising a handle connected to the other end of said stretchable tension member.

3. An exerciser as set forth in claim 1, said length adjustor mechanism comprising two finger plates fixed to said pin, both finger plates being exposed for use in moving said pin from said lock position to said release position.

4. An exerciser as set forth in claim 1, said length adjustor mechanism comprising a cap connected to said housing, said cap being removable from said housing to expose said cavity's interior for re-threading said stretchable tension member around said pin if needed.

5. An exerciser as set forth in claim 1, said cavity being of a generally horseshoe shaped configuration.

6. An exerciser comprising a stretchable tension member, the length of said stretchable tension member being variable as desired in order to vary the force resistance of said exerciser, a length adjustor mechanism to which said flexible tension member is connected at one end, said length adjustor mechanism including a housing having a cavity therein, said cavity being open through an access port to atmosphere, and said housing having opposed side walls, a pin slideable along an axis between a release position and a lock position within said cavity, said pin extending at each end through a slot in one of said side walls, a loop of said stretchable tension member being received in said cavity around said pin through said access port, the length of one end of said stretchable tension member being adjustable at said release position by pulling said flexible tension member around said pin and the length of that one end of said stretchable tension member being fixed at said lock position, a roller rotatably carried on said pin, said roller being in direct contact with said stretchable tension member during use, and one finger plate fixed to said pin at each end thereof, both finger plates being exposed for use in moving said pin from said lock position to said release position, said finger plates, pin and housing being sized so that the fingers on one of a user's hands can grip said pin therebetween to hold same in the release position while the other of the user's hands is pulling said flexible tension member around said pin, and a handle connected to said length adjustor mechanism by which said stretchable tension member can be stretched as desired by a user.

7. An exerciser as set forth in claim 6, said length adjustor mechanism comprising a cap connected to said housing, said cap being removable from said housing to expose said cavity's interior for re-threading said stretchable tension member around said pin if needed.

8. An exerciser as set forth in claim 6, said cavity being of a generally horseshoe shaped configuration.

* * * * *